US006824110B2

(12) United States Patent
Kane et al.

(10) Patent No.: US 6,824,110 B2
(45) **Date of Patent: *Nov. 30, 2004**

(54) METHOD AND SYSTEM FOR AUTOMATICALLY ACTIVATING A WARNING DEVICE ON A TRAIN

(75) Inventors: Mark Edward Kane, Orange Park, FL (US); James Francis Shockley, Orange Park, FL (US); Harrison Thomas Hickenlooper, Palatka, FL (US)

(73) Assignee: Quantum Engineering, Inc., Orange Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/619,425

(22) Filed: Jul. 16, 2003

(65) Prior Publication Data

US 2004/0015276 A1 Jan. 22, 2004

Related U.S. Application Data

(63) Continuation of application No. 10/184,929, filed on Jul. 1, 2002, now Pat. No. 6,609,049.

(51) Int. Cl.[7] ..... B61L 29/00

(52) U.S. Cl. ..... 246/293; 246/124; 246/122 R; 701/19

(58) Field of Search ..... 246/293, 122 R, 246/120, 121, 125, 124, 1 C, 1 R; 707/19, 20, 23, 213, 200, 207, 208, 36; 340/902; 104/27

(56) References Cited

U.S. PATENT DOCUMENTS

| | | | | |
|---|---|---|---|---|
| 4,181,943 A | | 1/1980 | Mercer, Sr. et al. | |
| 4,459,668 A | | 7/1984 | Inoue et al. | |
| 4,561,057 A | | 12/1985 | Haley, Jr. et al. | |
| 4,711,418 A | | 12/1987 | Aver, Jr. et al. | |
| 5,072,900 A | | 12/1991 | Malon | |
| 5,129,605 A | | 7/1992 | Burns et al. | |
| 5,177,685 A | | 1/1993 | Davis et al. | |
| 5,332,180 A | | 7/1994 | Peterson et al. | |
| 5,340,062 A | * | 8/1994 | Heggestad | 246/5 |
| 5,364,047 A | | 11/1994 | Petit et al. | |
| 5,394,333 A | | 2/1995 | Kao | |
| 5,398,894 A | | 3/1995 | Pascoe | |
| 5,452,870 A | | 9/1995 | Heggestad | |
| 5,533,695 A | | 7/1996 | Heggestad et al. | |
| 5,541,987 A | | 7/1996 | Lynn | |
| 5,620,155 A | * | 4/1997 | Michalek | 246/121 |
| 5,699,986 A | | 12/1997 | Welk | |
| 5,740,547 A | | 4/1998 | Kull et al. | |
| 5,751,569 A | | 5/1998 | Metel et al. | |
| 5,803,411 A | | 9/1998 | Ackerman et al. | |
| 5,828,979 A | | 10/1998 | Polivka et al. | |
| 5,867,122 A | | 2/1999 | Zahm et al. | |
| 5,944,768 A | | 8/1999 | Ito et al. | |
| 5,950,966 A | | 9/1999 | Hungate et al. | |

(List continued on next page.)

OTHER PUBLICATIONS

Judge, T., "BNSF/UP PTS Pilot Advances in Northwest", Progressive Railroading, May 1996.

Foran, P., "Train Control Quandary, Is CBTC viable? Railroads, Suppliers Hope Pilot Projects Provide Clues", Progressive Railroading, Jun. 1997.

(List continued on next page.)

*Primary Examiner*—Frantz F. Jules

(74) *Attorney, Agent, or Firm*—Piper Rudnick LLP; Steven B. Kelber

(57) ABSTRACT

A method and system for automatically activating a train warning device that uses a positioning system such as a global positioning system (GPS) receiver or an inertial navigation system (INS) to determine the train's position. The system further includes a database containing locations of grade crossings and other locations at which a train is required to give a warning signal and what regulations govern activation of the warning device at such locations.

20 Claims, 2 Drawing Sheets

U.S. PATENT DOCUMENTS

| | | | | | |
|---|---|---|---|---|---|
| 5,978,718 | A | | 11/1999 | Kull | |
| 5,995,881 | A | | 11/1999 | Kull | |
| 6,049,745 | A | | 4/2000 | Douglas et al. | |
| 6,081,769 | A | | 6/2000 | Curtis | |
| 6,102,340 | A | | 8/2000 | Peek et al. | |
| 6,112,142 | A | | 8/2000 | Shockley et al. | |
| 6,135,396 | A | * | 10/2000 | Whitfield et al. | 246/182 R |
| 6,179,252 | B1 | * | 1/2001 | Roop et al. | 246/293 |
| 6,218,961 | B1 | | 4/2001 | Gross et al. | |
| 6,311,109 | B1 | | 10/2001 | Hawthorne et al. | |
| 6,322,025 | B1 | | 11/2001 | Colbert et al. | |
| 6,345,233 | B1 | | 2/2002 | Erick | |
| 6,371,416 | B1 | | 4/2002 | Hawthorne | |
| 6,373,403 | B1 | | 4/2002 | Korver et al. | |
| 6,374,184 | B1 | | 4/2002 | Zahm et al. | |
| 6,377,877 | B1 | | 4/2002 | Doner | |
| 6,397,147 | B1 | | 5/2002 | Whithead | |
| 6,421,587 | B2 | | 7/2002 | Diana et al. | |
| 6,456,937 | B1 | | 9/2002 | Doner et al. | |
| 6,459,964 | B1 | | 10/2002 | Vu et al. | |
| 6,459,965 | B1 | * | 10/2002 | Polivka et al. | 701/19 |
| 6,487,478 | B1 | | 11/2002 | Azzaro et al. | |
| 6,494,408 | B2 | | 12/2002 | Katzer | |
| 6,519,512 | B1 | | 2/2003 | Haas et al. | |
| 2001/0056544 | A1 | | 12/2001 | Walker | |
| 2002/0070879 | A1 | | 6/2002 | Gazit et al. | |

OTHER PUBLICATIONS

"PTS Would've Prevented Silver Spring Crash: NTSB", Progressive Railroading, Jul. 1997.
Foran, P., "A 'Positive' Answer to the Interoperability Call", Progressive Railroading, Sep. 1997.
Foran, P., "How Safe is Safe Enough?", Progressive Railroading, Oct. 1997.
Foran, P., "A Controlling Interest In Interoperability", Progressive Railroading, Apr. 1998.
Derocher, Robert J., "Transit Projects Setting Pace for Train Control", Progressive Railroading, Jun. 1998.
Kube, K., "Variations on a Theme", Progressive Railroading, Dec. 2001.
Kube, K., "Innovation in Inches", Progressive Railroading, Feb. 2002.
Vantuono, W., "New York Leads a Revolution", Railway Age, Sep. 1996.
Vantuono, W., "Do you know where your train is?", Railway Age, Feb. 1996.
Gallamore, R., "The Curtain Rises on the Next Generation", Railway Age, Jul. 1998.
Burke, J., "How R&D is Shaping the 21st Century Railroad", Railway Age, Aug. 1998.
Vantuono, W., "CBTC: A Maturing Technology", Third International Conference On Communications Based Train Control, Railway Age, Jun. 1999.
Sullivan, T., "PTC—Is FRA Pushing Too Hard?", Railway Age, Aug. 1999.
Sullivan, T., "PTC: A Maturing Technology", Railway Age, Apr. 2000.
Moore, W., "How CBTC Can Increase Capacity", Railway Age, Apr., 2001.
Vantuono, W., "CBTC: The Jury is Still Out", Railway Age, Jun. 2001.
Vantuono, W., "New–tech Train Control Takes Off", Railway Age, May 2002.
Union Switch & Signal Intermittent Cab Signal, Bulletin 53, 1998.
GE Harris Product Sheet: "Advanced Systems for Optimizing Rail Performance" and "Advanced Products for Optimizing train Performance", undated.
GE Harris Product Sheet: "Advanced, Satellite–Based Warning System Enhances Operating Safety", undated.
Furman, E., et al., "Keeping Track of RF", GPS World, Feb. 2001.
"Testimony of Jolene M. Molitoris, Federal Railroad Administrator, U.S. Department of Transportation before the House Committee on Transportation and Infrastructure Subcommittee on Railroads", Federal Railroad Administration, United States Department of Transportation, Apr. 1, 1998.
"System Architecture, ATCS Specification 100", May 1995.
"A New World for Communications & Signaling", Progressive Railroading, May 1986.
"Advanced Train Control Gain Momentum", Progressive Railroading, Mar. 1986.
"Railroads Take High Tech in Stride", Progressive Railroading, May 1985.
Lyle, Denise, "Positive Train Control on CSXT", Railway Fuel and Operating Officers Association, Annual Proceedings, 2000.
Lindsey, Ron A., "C B T M, Communications Based Train Management", Railway Fuel and Operating Officers Association, Annual Proceedings, 1999.
Moody, Howard G, "Advanced Train Control Systems A System to Manage Railroad Operations", Railway Fuel and Operating Officers Association, Annual Proceedings, 1993.
Ruegg, G.A., "Advanced Train Control Systems ATCS", Railway Fuel and Operating Officers Association, Annual Proceedings, 1986.
Malone, Frank, "The Gaps Start to Close"Progressive Railroading, May 1987.
"On the Threshold of ATCS", Progressive Railroading, Dec. 1987.
"CP Advances in Train Control", Progressive Railroading, Sep. 1987.
"Communications/Signaling: Vital for dramatic railroad advances", Progressive Railroading, May 1988.
"ATCS's System Engineer", Progressive Railroading, Jul. 1988.
"The Electronic Railroad Emerges", Progressive Railroading, May 1989.
"$C^3$ Comes to the Railroads", Progressive Railroading, Sep. 1989.
"ATCS on Verge of Implementation", Progressive Railroading, Dec. 1989.
"ATCS Evolving on Railroads", Progressive Railroading, Dec. 1992.
"High Tech Advances Keep Railroads Rolling", Progressive Railroading, May 1994.
"FRA Promotes Technology to Avoid Train–To–Train Collisions", Progressive Railroading, Aug. 1994.
"ATCS Moving slowly but Steadily from Lab for Field", Progressive Railroading, Dec. 1994.
Judge, T., "Electronic Advances Keeping Railroads Rolling", Progressive Railroading, Jun. 1995.
"Electronic Advances Improve How Railroads Manage", Progressive Railroading, Dec. 1995.
Department of Transportation Federal Railroad Administration, Federal Register, vol. 66, No. 155, pp. 42352–42396, Aug. 10, 2001.

* cited by examiner

METHOD AND SYSTEM FOR AUTOMATICALLY ACTIVATING A WARNING DEVICE ON A TRAIN

This application claims priority and is a Continuation of U.S. patent application Ser. No. 10/184,929 filed Jul. 1, 2002, now U.S. Pat. No. 6,609,049, issued Aug. 19, 2003. The entirety of this patent is incorporated herein by reference.

BACKGROUND OF THE INVENTION

1. Field of the Invention

The invention relates to automated railroad operation generally, and more particularly to a system and method for automatically activating a train warning device at a location for which a warning is required or desirable, such as a grade crossing.

2. Discussion of the Background

More than 4,000 collisions between trains and vehicles occur at public and private highway-rail grade crossings every year, resulting in more than 400 deaths annually. Approximately 50% of these accidents occur at grade crossings with active warning devices such as bells, flashing lights, and/or gates. Recently, some state and local governments enacted legislation prohibiting the use of horns at certain location and/or times. The Federal Railroad Administration (FRA) has studied the effect of this legislation. As a result of this study, the FRA determined that the sounding of train horns significantly reduces accidents at grade crossings. 65 Federal Register 2230 et seq.

As a result, the FRA promulgated several regulations, including 49 C.F.R. § 222.21, which regulates how and when horns are to be sounded. Under 49 C.F.R. § 222.21, in the absence of a state regulation, a horn must be sounded starting at a position no greater than ¼ mile away from the grade crossing. Furthermore, the railroad must place a whistle board (a wayside sign telling the conductor to begin sounding a horn) at a location such that a train traveling at the maximum speed will begin sounding its horn 20 seconds before the crossing, or the railroad must ensure by other methods that the horn is sounded no less than 20 seconds, but not more than 24 seconds, before the locomotive enters the grade crossing. If a state regulation is currently in place, the rule does not disturb the state regulation until a change in the maximum allowable speed is made, at which time the requirement of 49 C.F.R. § 222.21 become effective. It will be readily apparent from the above discussion that precisely determining when to begin sounding a train horn is not a trivial task.

Even if a device such as a whistle board is present to inform an engineer as to the precise location to begin sounding a train horn, engineers sometimes make mistakes and don't begin sounding the horn at the right time. In many court cases brought against the railroad operator relating to grade crossing accidents, the engineer is accused of causing the accident by failing to blow the horn correctly.

What is needed is a method and system that will automatically activate a horn in a prescribed manner at an appropriate place and time.

SUMMARY OF THE INVENTION

The present invention meets the aforementioned need to a great extent by providing a method and system for automatically activating a train warning device that uses a positioning system such as a, global positioning system (GPS) receiver or an inertial navigation system (INS) to determine the train's position. The system further includes a database containing locations of grade crossings and other locations at which a train is required to activate a warning device, as well as what regulations govern activation of the warning device at such locations.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION

The present invention will be discussed with reference to preferred embodiments of train control systems. Specific details, such as regulations, distances and times, are set forth in order to provide a thorough understanding of the present invention. The preferred embodiments and specific details discussed herein should not be understood to limit the invention.

Figure 1:
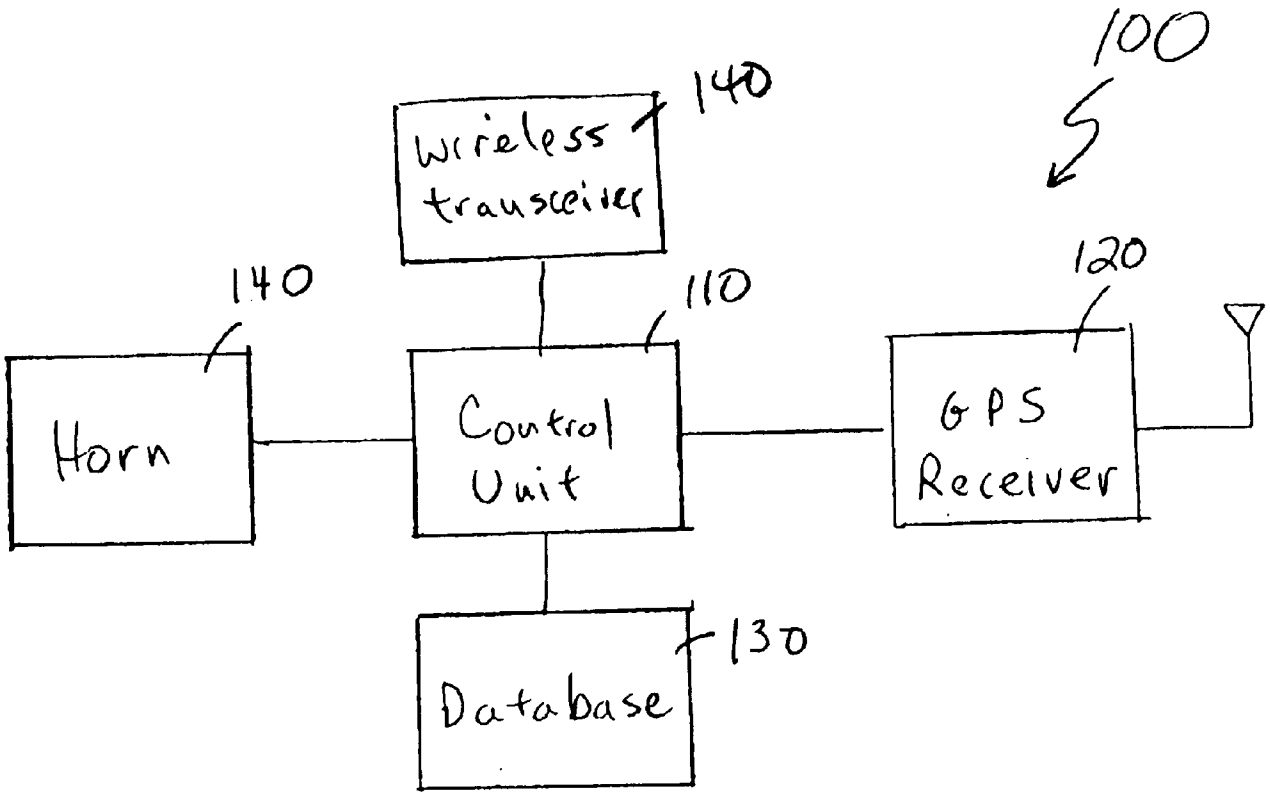
FIG. 1 is a logical block diagram of a train control system according to one embodiment of the invention.

Referring now to the drawings, wherein like reference numerals designate identical or corresponding parts throughout the several views, FIG. 1 is a logical block diagram of a train control system 100 according to the present invention. The system 100 includes a control unit 110, which typically, but not necessarily, includes a microprocessor. The control unit 110 is connected to a positioning system such as a GPS receiver 120. The GPS receiver 120 can be of any type, including a differential GPS receiver. Other types of positioning systems, such as inertial navigation systems (INSs) can also be used. The GPS receiver 120 provides position and speed information to the control unit 110.

A database 130, which contains the locations of all grade crossings in the system (or in the area in which the train is to operate) is also connected to the control unit 110. In some embodiments, the database 130 can be updated through wireless communication (via wireless transceiver 140) or other means to accept changes in grade crossing information. The control unit 110 uses the position information from the GPS receiver 130 as an index into the database 130 to determine the nearest grade crossing being approached by the train.

The control unit 110 is also connected to an electrically activated horn 140. Although a horn 140 is used in the embodiment of FIG. 1, it should be understood that any type of warning device, or combination of warning devices, including visual and audio warning devices, could be used.

Figure 2:
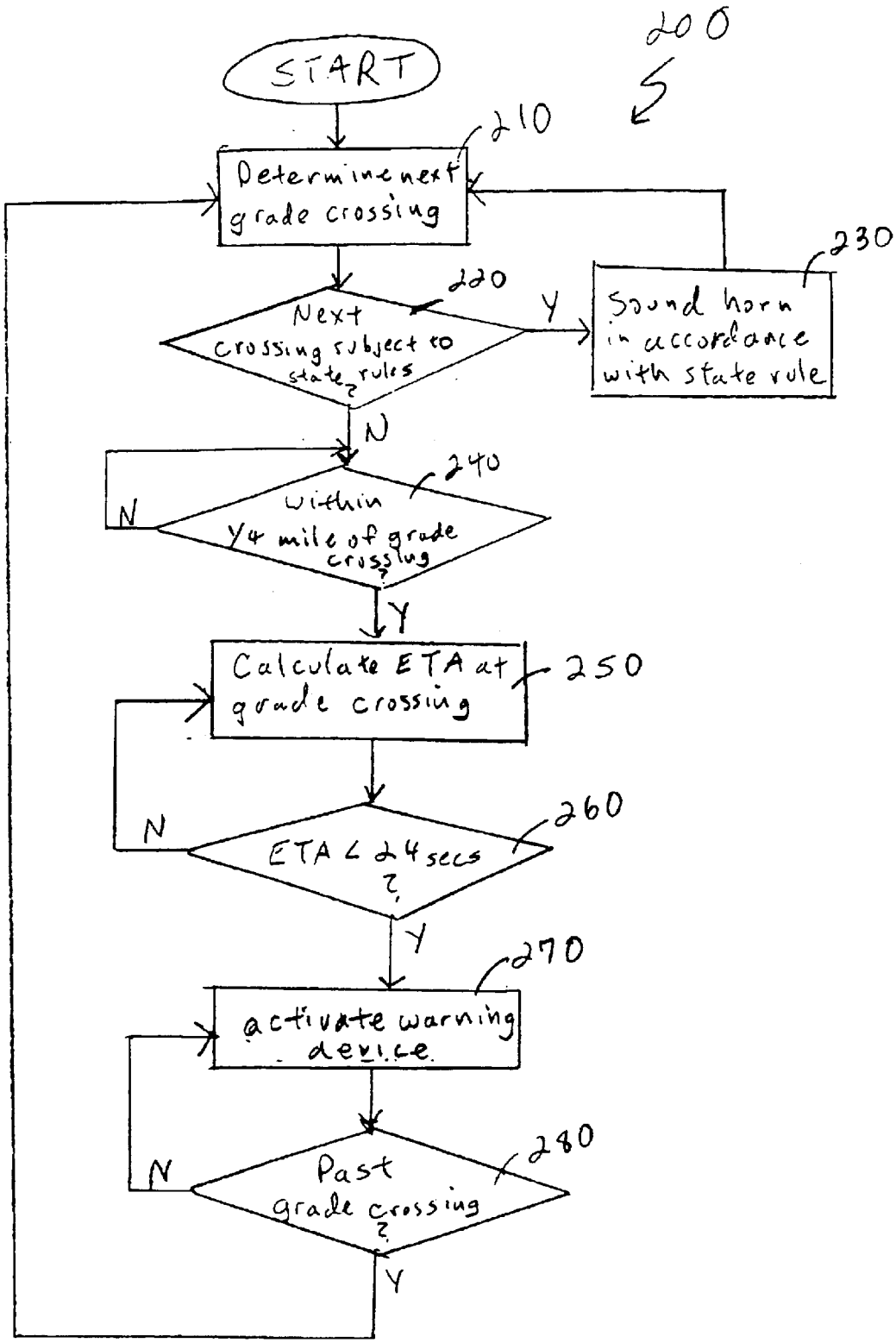
FIG. 2 is a flowchart showing an automatic horn sounding method according to one embodiment of the invention.

Referring now to FIG. 2, a flowchart 200 illustrates operation of an automatic warning device activation method according to one embodiment of the present invention. The control unit 110 determines the next grade crossing based on the location of the train as reported by the GPS receiver 120 by indexing the database 130 at step 210. If the next grade crossing is subject to state regulations at step 220, the warning device (e.g., horn) is activated in accordance with state regulations at step 230 and the process starts over at step 210.

If the next grade crossing is not subject to state regulations, then the system treats the grade crossing as subject to the aforementioned FRA regulation, 49 C.F.R. § 222. The control unit 110 then determines whether the train is within ¼ mile of the grade crossing at step 240. If not, step 240 is repeated. When the train is within ¼ mile of the grade crossing at step 240, the control unit 110 next calculates the estimated time of arrival of the train at the grade crossing, based on the position and speed of the train as reported by the GPS receiver 120, at step 250. If the estimated time of arrival is less than 24, seconds, step 250 is repeated using updated speed and position information at step 250. If the estimated time of arrival is less than 24 seconds at step 260, the warning device is activated at step 270. In some embodiments in which the warning device includes a horn, the horn is sounded in a two long, one short, one long sequence. If the control unit determines that the train has not cleared the grade crossing at step 280, step 270 is repeated. If the grade crossing has been cleared, the process is repeated starting at step 210.

It will be readily understood by those of skill in the art that the aforementioned invention can be practiced as a stand-alone system or may be practiced as part of an automated train control system. The database 130 may be programmed via wireless communications from a dispatcher or central authority, or may be periodically updated by reading data from a tape or flash memory in a manner well known in the art.

The embodiment described above has been discussed with reference to grade crossings. It will be readily understood by those of skill in the art that the invention can be used in connection with any location, temporary or permanent, at which it is required or desirable to activate a warning device. One example of such a temporary location is an area of track being worked on by maintenance personnel.

Obviously, numerous modifications and variations of the present invention are possible in light of the above teachings. It is therefore to be understood that within the scope of the appended claims, the invention may be practiced otherwise than as specifically described herein.

What is claimed is:

1. A computerized method for activating a warning device on a train at a location comprising the steps of:

maintaining a database of locations at which the warning device must be activated and corresponding regulations concerning activation of the warning device;

obtaining a position of the train from a positioning system;

selecting a next upcoming location from among the locations in the database based at least in part on the position;

determining a point at which to activate the warning device in compliance with a regulation corresponding to the next upcoming location; and activating the warning device at the point.

2. The method of claim 1, wherein the point is a point in space.

3. The method of claim 1, wherein the point is a point in time.

4. The method of claim 1, wherein the determining step includes the step of determining a distance from the train to the next upcoming location based on the position obtained in the obtaining step.

5. The method of claim 1, wherein the determining step includes the step of determining a time at which the train will arrive at the next upcoming location based on a speed of the train and the position of the train obtained in the obtaining step.

6. The method of claim 1, wherein the warning device is a horn.

7. The method of claim 1, wherein the location is a grade crossing.

8. The method of claim 1, further comprising the step of updating the database via wireless communication.

9. The method of claim 1, wherein the positioning system is a global positioning system.

10. The method of claim 1, wherein the positioning system is an inertial navigation system.

11. A system for automatically activating a warning device on a train at a location, the system comprising:

a control unit connected to the warning device;

a storage device connected to the control unit, the storage device having stored therein a database of locations at which the warning device must be activated and corresponding regulations concerning activation of the warning device;

a positioning system in communication with the control unit, the positioning system being configured to supply a position of the train to the control unit; and wherein the control unit is configured to perform the steps of selecting a next upcoming location from among the locations in the database;

determining a point at which to activate the warning device in compliance with a regulation corresponding to the next upcoming location; and activating the warning device at the point.

12. The system of claim 11, wherein the point is a point in space.

13. The system of claim 11, wherein the point is a point in time.

14. The system of claim 11, wherein the determining step includes the step of determining a distance from the train to the next upcoming location based on the position obtained in the obtaining step.

15. The system of claim 11, wherein the determining step includes the step of determining a time at which the train will arrive at the next upcoming location based on a speed of the train and the position obtained in the obtaining step.

16. The system of claim 11, wherein the warning device is a horn.

17. The system of claim 11, wherein the location is a grade crossing.

18. The system of claim 11, wherein the system farther comprises a wireless transceiver connected to the control unit and the control unit is further configured to update the database with information received via the wireless transceiver.

19. The system of claim 11, wherein the positioning system is a global positioning system receiver.

20. The system of claim 11, wherein the positioning system is an inertial navigation system.

* * * * *